United States Patent [19]

Thomas

[11] Patent Number: 4,640,012

[45] Date of Patent: Feb. 3, 1987

[54] RAZOR CONSTRUCTION

[76] Inventor: Perry W. Thomas, 12708 12th St., Grandview, Mo. 64030

[21] Appl. No.: 737,781

[22] Filed: May 28, 1985

[51] Int. Cl.[4] ..... B26B 21/22

[52] U.S. Cl. ..... 30/41; 30/32

[58] Field of Search ..... 30/41, 41.5, 32

[56] References Cited

U.S. PATENT DOCUMENTS

| | | | |
|---|---|---|---|
| 1,852,708 | 4/1932 | Stuart | 30/41 |
| 2,010,446 | 8/1935 | Stuart | 30/41 |
| 2,319,980 | 5/1943 | Des Jardins | 30/41 |
| 2,336,806 | 12/1943 | Schenk et al. | 30/41 |
| 2,704,397 | 3/1955 | Turgi | 30/41 |
| 2,705,365 | 4/1955 | Van Heest | 30/41 |
| 3,832,774 | 9/1974 | Perry | 30/32 |
| 4,205,441 | 6/1980 | Turner | 30/41.5 |
| 4,212,103 | 7/1980 | Schuman-Hoole | 30/32 |
| 4,535,537 | 8/1985 | Ferraro | 30/41 |

*Primary Examiner*—Jimmy C. Peters

*Attorney, Agent, or Firm*—Kokjer, Kircher, Bradley, Wharton, Bowman & Johnson

[57] ABSTRACT

A manual razor having a pair of water passages in the shaving head for cleaning of the blade area. The passages extend into opposite ends of the shaving head and are separated by a partition. Water is applied to the passages by placing them under a faucet. Outlet slots direct the water from the passages to the blade area and into the gap between the blades of a two edge razor to remove accumulated shaving lather and whiskers. Curved baffles are spaced along each passage to distribute the water along the outlet slots for thorough cleaning of the blades.

11 Claims, 4 Drawing Figures

RAZOR CONSTRUCTION

BACKGROUND AND SUMMARY OF THE INVENTION

This invention relates generally to razors and more particularly to a manual razor having a shaving head which is specially constructed to facilitate cleaning of the razor blades.

Although manual razors are available in a variety of different types, they all include a shaving head which includes one or more razor blades. In recent years, two edge razors have been especially popular because of their ability to achieve a close shave. In one type of razor, the blades can be removed from the shaving head and discarded when they lose their sharpness. Another razor construction includes a replaceable shaving head which can be detached from the handle and discarded when the blades become worn. Disposale razors are also available and are intended to be discarded in their entireties when the blades lose their sharpness. Pivotal shaving heads and blades that are adjustable in their angle are special features that are provided in some razors.

All manual razors are subject to the accumulation of shaving lather and severed whiskers in the area of the blades, and this material must be removed from time to time in order to keep the razor in condition to provide a close shave and avoid undue irritation of the skin. Typically, the shaving head is either dipped in water or rinsed under a faucet to remove the accumulated lather and whiskers while at the same time wetting the blades. Although this procedure usually removes the majority of the lather and whiskers, it does not always remove all of the accumulated materials and particularly the material that is firmly lodged in place in the shaving head. The small gap that is present between the two blades in a two edge razor is especially prone to becoming clogged with shaving debris, and material which remains in this gap can reduce the effectiveness of the razor and increase the skin irritation.

Various types of special razors have been proposed to facilitate cleaning of the blade area. However, none of these devices has been entirely satisfactory in all respects. Razors such as that shown in U.S. Pat. No. 4,226,019 to Sugiyama require a special mechanical ejector member for physically pushing material out of the space between the two blades, and this adds appreciably to the cost and complexity. The razor shown in U.S. Pat. No. 4,205,441 to Turner relies upon suction to maintain the blade area clear of material and also requires an overly complicated construction of the razor. U.S. Pat. Nos. 4,177,556 to Galli and 4,228,586 to Thierry disclose the concept of applying water through the razor handle to the blade area during the course of shaving. This involves the provision of a passage through the entire length of the handle and also requires long flexible tubing and special connections to connect the free end of the handle with a water faucet or other source of water.

The present invention is directed to an improved razor which is constructed in a simple and economical manner and yet can be easily and thoroughly cleaned to remove accumulated shaving lather and whiskers. In accordance with the invention, a two bladed shaving head is provided with a pair of passages which extend into its opposite ends. Water for cleaning of the blades can be applied to the passages by placing them under a running faucet. The water is forced out of the shaving head though outlet slots which apply the water to the shaving edges of the razor blades and to the area between the blades to dislodge accumulated shaving material. The passages are separated by an internal partition which prevents water applied to one passage from simply flowing out the other passage. Baffles are spaced along the length of each passage to distribute the water along the lengths of the blades.

By virtue of the construction of the shaving head, shaving lather and severed whiskers can be completely flushed by water from the blade area from time to time to prevent undue accumulations between the blades or elsewhere in the blade area. By maintaining the blades free of accumulated mateial, the ability of the razor to provide close shaves is enhanced and the skin irritation is reduced. Cleaning of the razor can be easily carried out simply by first placing one end of the shaving head and then the other end beneath a faucet. The baffle arrangement and the provision of a partition between the two passages assures that the water will be distributed throughout the blade area to clean the entire length of each blade. At the same time, the razor is constructed in a simple and economical manner and requires only minor variations from a conventional razor construction.

DETAILED DESCRIPTION OF THE INVENTION

In the accompanying drawing which forms a part of the specification and is to be read in conjunction therewith and in which like reference numerals are used to indicate like parts in the various views.

Figure 1:
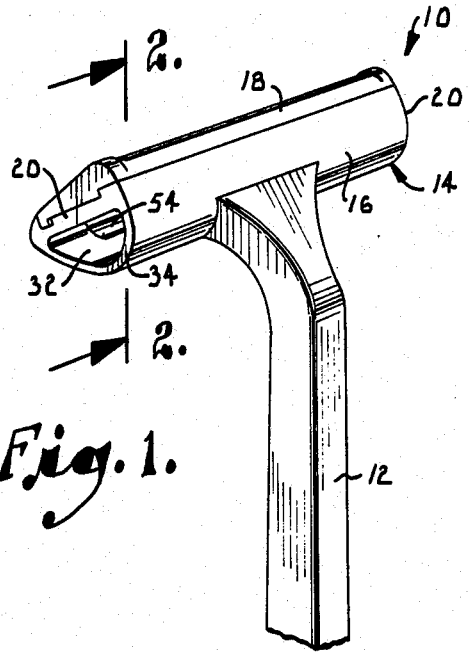
FIG. 1 is a fragmentary perspective view of a razor constructed according to a preferred embodiment of the present invention.
Figure 2:
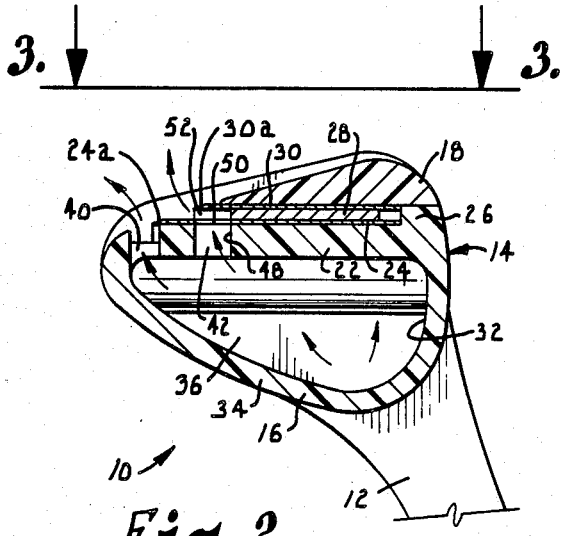
FIG. 2 is a fragmentary sectional view on an enlarged scale taken generally along line 2—2 of FIG. 1, with the directional arrows indicating the flow of water during cleaning of the razor.
Figure 3:
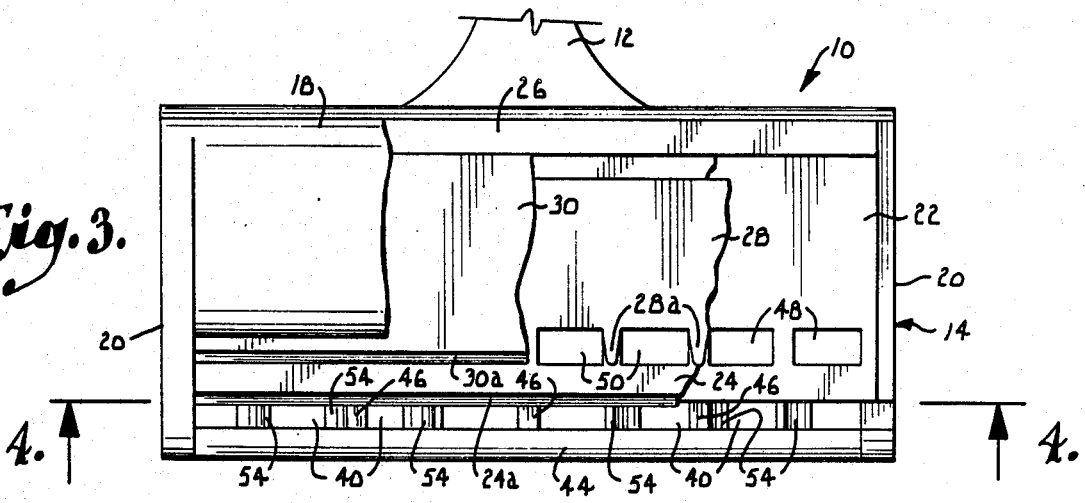
Figure 4:
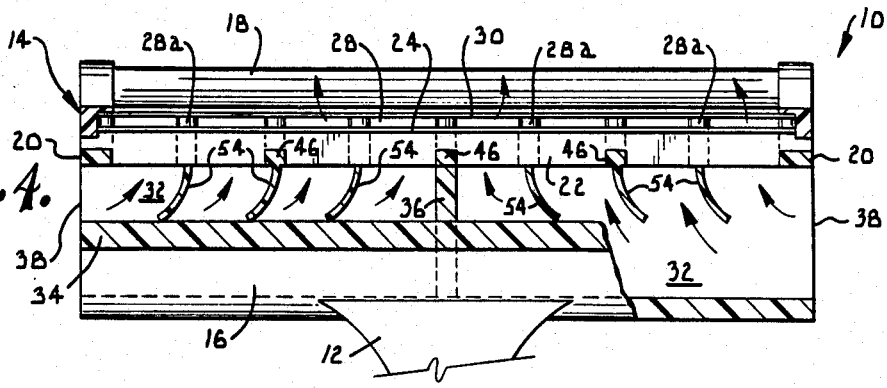

FIG. 3 is a fragmentary top plan view taken generally along line 3—3 of FIG. 2 in the direction of the arrows, with portions broken away for purposes of illustration; and FIG. 4 is a sectional view taken generally along line 4—4 of FIG. 3 in the direction of the arrows, with a portion broken away for purposes of illustration and the directional arrows indicating the flow water during cleaning of the razor.

Referring now to the drawing in detail, numeral 10 generally designates a razor constructed in accordance with the present invention. The razor 10 includes the usual handle 12 which carries a shaving head 14 on one end. The shaving head 14 is formed by a main body 16 which connects with the handle 12 and a cap 18 which is suitably secured on top of the main body 16. The longitudinal dimension of the shaving head 14 is defined between opposite ends 20 which are located on opposite sides of the handle 12.

As best shown in FIG. 2, the main body 16 of the shaving head has an upper wall 22 which presents a flat top surface on which a razor blade 24 is seated. The back edge of blade 24 engages a shoulder 26 which extends along the back edge portion of body 16. Blade 24 has a sharp front shaving edge **24*a* which is exposed at the front of the shaving head. A flat spacer plate 28 is sandwiched between blade 24 and another blade 30** located on top of the spacer plate 28. Blade 30 has an exposed front edge 30*a* which cooperates with edge 24*a* in the shaving of whiskers. The cap 18 immediately overlies blade 30 and is suitably secured to the main body 16 in order to hold the blade assembly in place. The front edge of the spacer plate 28 is provided with a plurality of projecting teeth 28*a* having tips which terminate adjacent to edge 30*a*.

In accordance with the present invention, the main body 16 of the shaving head is hollow in order to present a pair of passages 32 which are best shown in FIGS. 2 and 4. The passages 32 are formed between the upper wall 22 and a curved lower wall 34 of body 16 which connects with the front and back edges of the upper wall 22. A central partition 36 extends between the upper and lower walls 22 and 34 to form a barrier which separates the two passages 32 from one another at the center of the shaving head 14. The passages 32 extend into the opposite ends 20 of the shaving head, and each passage has an open inlet end 38 located at the corresponding end 20. The passages 32 extend longitudinally in the shaving head 14, and each passage has a length of approximately half the length of the shaving head between its opposite ends 20. The passages are axially aligned with one another.

Each passage 32 has two sets of outlet slots 40 and 42 (FIG. 2) for discharging water in the area of the blade edges 24*a* and 30*a*. As best shown in FIG. 3, the front slots 40 are formed between the upper wall 22 and a bar 44 which is spaced beyond the front edge of wall 22 and connected therewith by a plurality of short connecting bars 46. The slots 40 are separated from one another by the bars 46 and extend adjacent to edge 24*a* along its entire length.

The outlet slots 42 are partially formed by passages 48 which extend through the upper wall 22. The passages 48 are aligned with identically sized openings 50 which extend through blade 24. As shown in FIG. 2, the slots 42 open into the gap 52 which is formed between the two blades 24 and 30. The aligned passages 48 and openings 50 are spaced along the length of the shaving head 14 in order to apply water along the entire length of the gap 52. As shown in FIG. 3, each opening 50 extends between an adjacent pair of the teeth 28*a* on the spacer plate 28.

Each passage 32 is provided with a plurality of curved vanes or baffles 54 which assist in distributing the water along the lengths of the outlet slots 40 and 42. Each baffle 54 extends across the entire width of passage 32 and is connected at its top edge with the upper wall 22 of the main body 16. The lower edge of each baffle 54 is located above the bottom of passage 32 so that water can flow beneath the baffles. The baffles 54 connect with wall 22 at locations between the passage 48. Each baffle has a concave surface which faces the water flowing in the passage 32.

The razor 10 is used in the usual manner with shaving cream or gel to shave whiskers and the like. The special construction of the shaving head 14 facilitates periodic cleaning of shaving lather and severed whiskers from the area of the blade edges 24*a* and 30*a* and from the gap 52 between the blade edges. To clean the razor, it is placed alternately with one end 20 and then the other end 20 beneath a faucet which is turned on to provide a flow of hot water. The water enters each passage 32 through its inlet 38 and discharges from the passage through the outlet slots 40 and 42. The water which passes through slots 40 cleans blade edge 24*a* and the adjacent area to remove accumulated shaving debris and at the same time wet the edge 24*a*. The water which passes through slots 42 enters the gap 52 and flows out between the two blade edges 24*a* and 30*a* in order to remove shaving debris from the gap 52 and the adjacent areas of the blade edges. The water pressure is normally sufficient to remove even firmly lodged particles from the gap 52.

The center partition 36 separates the two passages 32 from one another and forms a barrier which prevents water that enters one passage from simply flowing into the other passage and out of the shaving head through the other passage inlet. The baffles 54 distribute the water along the length of each passage 32 and assist in directing the water toward all of the outlet slots 40 and 42. Each baffle 54 diverts some of the water from passage 32 toward the outlet slot served by the baffle. In this respect, the curved shape of each baffle is important is providing an adequate flow of water through the corresponding outlet slots. Water which reaches the partition 36 is deflected to the outlets which are located between the partition and the nearest baffle 54.

Because the outlet slots 40 and 42 are spaced along the entire length of each blade edge 24*a* and 30*a*, water for cleaning of the razor is applied along the entire blade length in order to assure thorough cleaning of all areas of the blades. By applying water first to one passage 32 and then to the other passage 32 for a few moments, accumulated debris is effectively removed from the entire shaving region, including the gap 52 which tends to become clogged with severed whiskers.

It should be understood that the blades 24 and 30 can be made removable from the shaving head 14, or the shaving head itself can be made removable from the handle 12. Also, the shaving head 14 may be pivotally mounted on the handle and the blades may be made adjustable to vary the shaving angle. It should also be understood that a single passage can be formed to extent continuously through the shaving head and blocked at one end. However, it has been found that the provision of two passages with a central partition separating them results in more uniform application of water along the length of the shaving head for more thorough and effective removal of accumulated shaving debris.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A razor comprising:

a shaving head having opposite ends and a longitudinal dimension defined between said ends;

a razor blade carried on said shaving head and having an exposed shaving edge extending generally longitudinally on said head for use in shaving;

a handle extending from said shaving head;

a passage extending generally longitudinally within said shaving head and having an inlet end at one end of the shaving head for receiving water;

an outlet for said passage located adjacent said shaving edge of the blade for discharging water from the passage against said edge to clear shaving debris from the blade; and a plurality of curved baffles in said passage spaced apart from one another at locations to divert water from the passage toward said outlet, each baffle having a concave surface facing toward said inlet end of the passage.

2. A razor as set forth in claim 1, including:

a second passage extending generally longitudinally within said shaving head and having an inlet end at the end of said head opposite said one end;

means for separating said second passage form the first mentioned passage; and an outlet for said second passage located adjacent said shaving edge for discharging water from the second passage against said edge to clean shaving debris from the blade, said baffles being distributed along the length of each of said first and second passages.

3. A razor as set forth in claim 2, wherein said separating means comprises a partition in said shaving head located between said passages.

4. A razor as set forth in claim 2, wherein the outlets for the first and second passages comprise slots together extending substantially along the entire length of said blade.

5. A razor as set forth in claim 2, including a second razor blade carried on said shaving head and having an exposed shaving edge spaced from the edge of the first mentioned blade by a gap, said outlets being arranged to direct water from the passages into said gap to dislodge shaving debris accumulated therein.

6. A razor as set forth in claim 5, wherein the outlet for each passage includes first and second slots, said first slot being located to direct water adjacent the edge of the first blade and said second slot being located to direct water into said gap.

7. A razor as set forth in claim 1, wherein:

said shaving head carries a second razor blade having an exposed shaving edge spaced from the edge of the first mentioned blade by a gap; and said outlet includes first and second slots, said first slot being located and arranged to direct water from said passage toward said shaving edge of the first blade along substantially the entire length thereof and said second slot being located and arranged to direct water from said passage into said gap along substantially the entire length thereof.

8. A razor comprising:

a shaving head having opposite ends and a longitudinal dimension defined between said ends;

a pair of blades on said head spaced apart from one another and presenting exposed shaving edges separated from one another by a gap;

a handle extending from the shaving head;

a passage extending generally longitudinally in said shaving head and having an inlet end at one end of the shaving head for receiving water, said passage extending substantially the entire length of the shaving head for distributing the water along the length of the shaving head;

a first set of outlets for said passage, said first set of outlets being located and arranged to direct water from said passage into said gap to dislodge shaving debris accumulated in the gap; and a second set of outlets for said passage located and arranged to direct water from said passage adjacent the shaving edge of one of the blades on a side of said one blade opposite the gap.

9. In a razor having a shaving head with opposite ends, a blade on the shaving head presenting an exposed shaving edge extending substantially between said opposite ends, and a handle extending from the shaving head, the improvement comprising:

a pair of passages extending into opposite ends of said shaving head for receiving water used to clean the razor;

a partition in said head forming a barrier separating said passages from one another; and an outlet for each passage located adjacent said shaving edge of the blade for discharging water from the passages and applying the water to said edge to clean the same, said outlets together extending along substantially the entire length of said blade to apply water along the length of said shaving edge.

10. The improvement of claim 9, including a plurality of spaced apart baffles in each passage arranged to divert water from the passage toward the outlet thereof in a manner to distribute water along the length of each outlet.

11. The improvement of claim 9, wherein:

said razor has a second blade thereon presenting an exposed shaving edge spaced from the edge of the first mentioned blade by a gap;

said outlets extend through one of said blades and open into said gap to apply water thereto for dislodging accumulated shaving debris.

* * * * *